US008662591B2

(12) United States Patent
Lin

(10) Patent No.: US 8,662,591 B2
(45) Date of Patent: Mar. 4, 2014

(54) RECLINING CHAIR HEADREST WITH HEIGHT ADJUSTMENT MECHANISM

(76) Inventor: Yu-Jen Lin, Kaohsiung Hsien (TW)

( * ) Notice: Subject to any disclaimer, the term of this patent is extended or adjusted under 35 U.S.C. 154(b) by 329 days.

(21) Appl. No.: 13/275,315

(22) Filed: Oct. 18, 2011

(65) Prior Publication Data

US 2013/0093232 A1 Apr. 18, 2013

(51) Int. Cl.
*A47C 1/10* (2006.01)

(52) U.S. Cl.
USPC ..... 297/397; 297/391; 297/399; 297/400; 297/406; 297/408; 297/410

(58) Field of Classification Search
USPC ..... 297/391, 393, 397, 399, 400, 402, 406, 297/408, 410
See application file for complete search history.

(56) References Cited

U.S. PATENT DOCUMENTS

| | | | | |
|---|---|---|---|---|
| 236,212 | A * | 1/1881 | Cartwright | 297/402 |
| 247,208 | A * | 9/1881 | Miller | 297/393 |
| 1,029,315 | A * | 6/1912 | Poll | 297/409 |
| 3,572,835 | A * | 3/1971 | Kees et al. | 297/410 |
| 3,885,831 | A * | 5/1975 | Rasmussen | 297/410 |
| 6,616,236 | B1 * | 9/2003 | Su | 297/410 |
| 7,494,188 | B1 * | 2/2009 | Lin | 297/397 |
| 7,549,704 | B1 * | 6/2009 | Chou et al. | 297/408 |
| 7,690,729 | B2 * | 4/2010 | Liao | 297/408 |
| 7,832,803 | B2 * | 11/2010 | Cassaday | 297/408 |
| 7,914,079 | B2 * | 3/2011 | Link | 297/408 |
| 2004/0070252 | A1 * | 4/2004 | Stenzel et al. | 297/408 |
| 2007/0085401 | A1 * | 4/2007 | Hunziker et al. | 297/410 |
| 2008/0309139 | A1 * | 12/2008 | Oda | 297/410 |

* cited by examiner

*Primary Examiner* — Laurie Cranmer

(57) ABSTRACT

A chair includes at least one leg; a rotatable seat; a backrest; and a headrest including a clamping member having a yoke with two hollow cylindrical yoke arms; two hook members extending forward downward from both sides of the yoke respectively; and a lower well; a support including a hinge head pivotably disposed between the yoke arms; and two opposite fastening portions; a head frame including two rear bars and two joints frictionally, slidably fastened on the bars, each joint frictionally, pivotably secured to the fastening portion; a hooking member in the well and including two hook elements curved upward forward wherein the hook elements cooperate with the hook members to releasably mount the headrest on the backrest; a first hinge element pivotably disposed in one yoke arm and includes a lever; and a second hinge element moveably disposed in the other yoke arm and the hinge head.

4 Claims, 12 Drawing Sheets

RECLINING CHAIR HEADREST WITH HEIGHT ADJUSTMENT MECHANISM

BACKGROUND OF THE INVENTION

1. Field of the Invention

The invention relates to furniture structural members and more particularly to a reclining headrest for a chair (e.g., office chair), the headrest having a height adjustment mechanism.

2. Description of Related Art

Chairs (e.g., office chairs) having a reclining headrest are well known. Typically, the headrest is adapted to dispose in an upright position, a horizontal position, or a reclined position therebetween.

However, the conventional recline mechanisms are complicated, inconvenient in tilt angle adjustment, and liable to malfunction. Thus, the need for improvement still exists.

Further, a reclining headrest for a chair, the headrest having a height adjustment mechanism, has not been disclosed as far as the present inventor is aware.

SUMMARY OF THE INVENTION

It is therefore one object of the invention to provide a chair comprising at least one leg; a seat rotatably mounted on a top portion of the leg; a backrest extending upwardly from a rear end of the seat; and a headrest comprising a clamping member comprising an upper yoke including two opposite, hollow, cylindrical yoke arms; two intermediate spaced hook members extending forward downward from both sides of the yoke respectively; and a lower well; a support comprising a cup-shaped hinge head pivotably disposed between the yoke arms; and two opposite fastening portions; a head frame comprising two rear bars and two joints each frictionally, slidably fastened on the bar, each joint being frictionally, pivotably secured to the fastening portion; a hooking member fastened in the well and comprising two spaced hook elements curved upward forward wherein the hook elements cooperate with the hook members to releasably mount the headrest on an upper portion of the backrest; a first hinge element pivotably disposed in one yoke arm and comprises a lever; and a second hinge element moveably disposed in the other yoke arm and the hinge head, wherein the lever can be rotated counterclockwise to securely fasten the hinge head.

The above and other objects, features and advantages of the invention will become apparent from the following detailed description taken with the accompanying drawings.

DETAILED DESCRIPTION OF THE INVENTION

Figure 1:
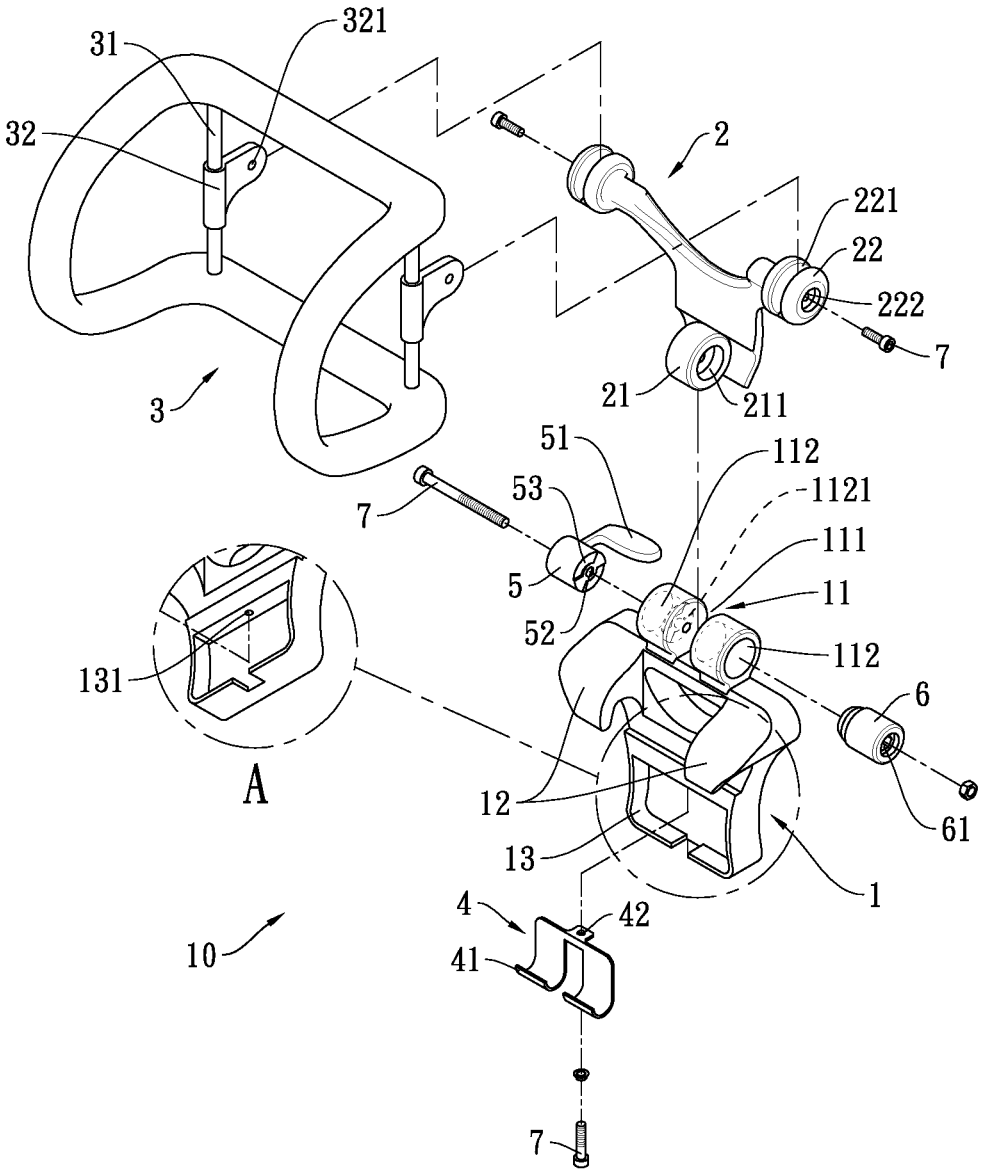
FIG. 1 is an exploded view of a reclining headrest for a chair according to the invention.
Figure 2:
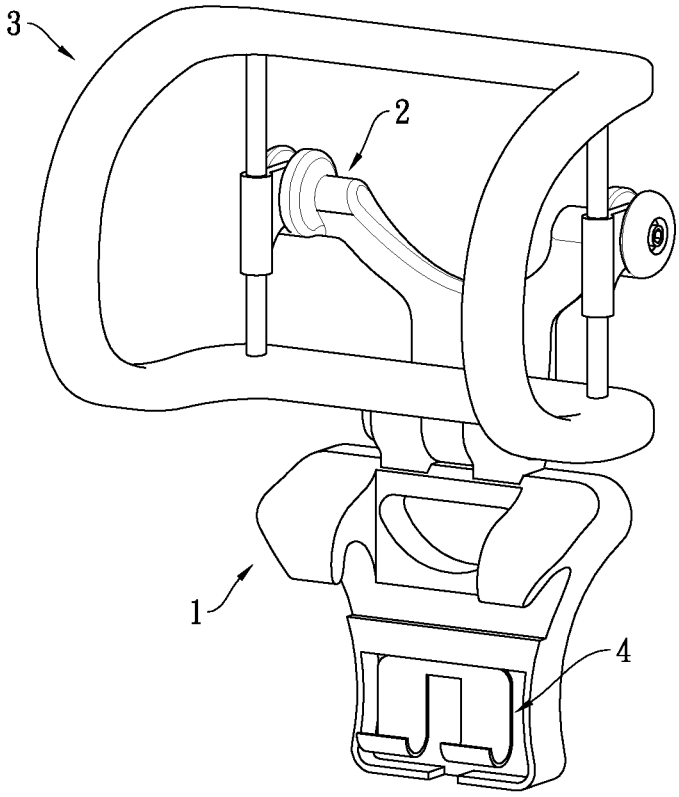
FIG. 2 is a perspective view of the assembled headrest.
Figure 3:
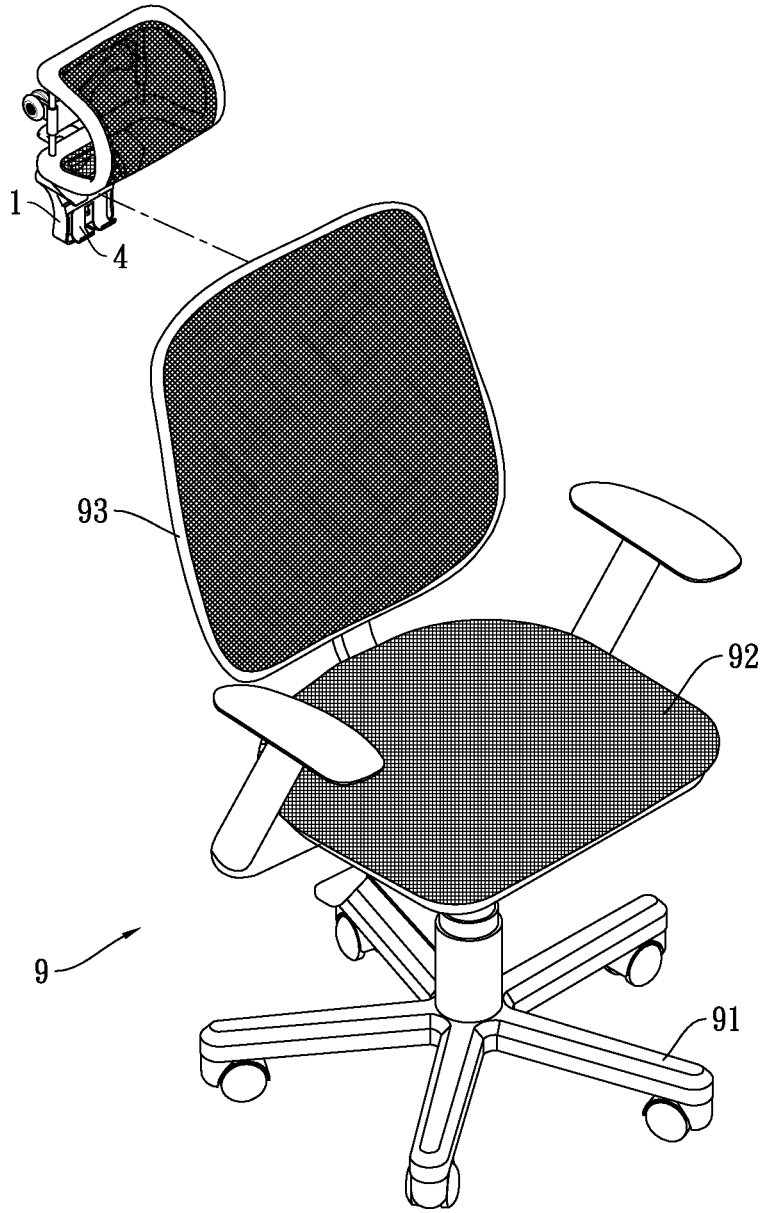
FIG. 3 is a perspective view of an office chair with the headrest to be mounted thereon.
Figure 4:
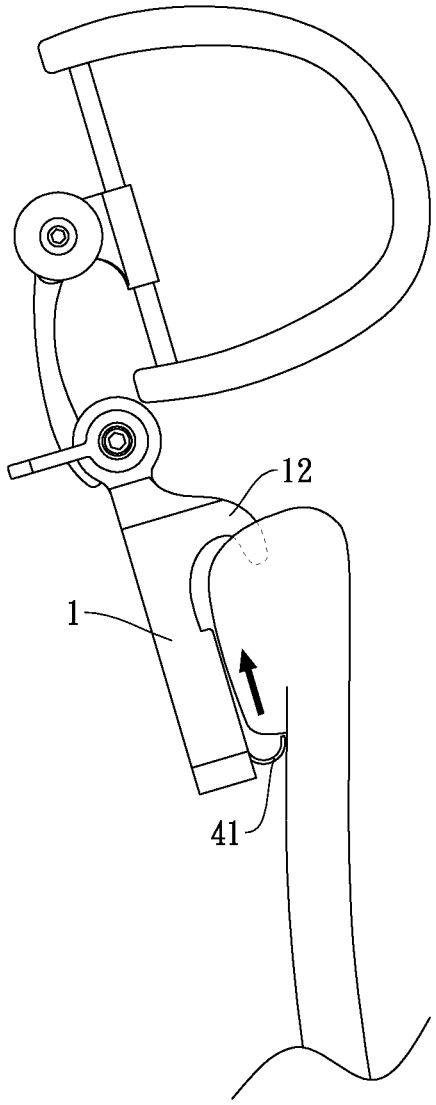
FIG. 4 is a side elevation of the headrest and a top portion of backrest of the chair after mounting the headrest on the backrest of the chair.
Figure 5:
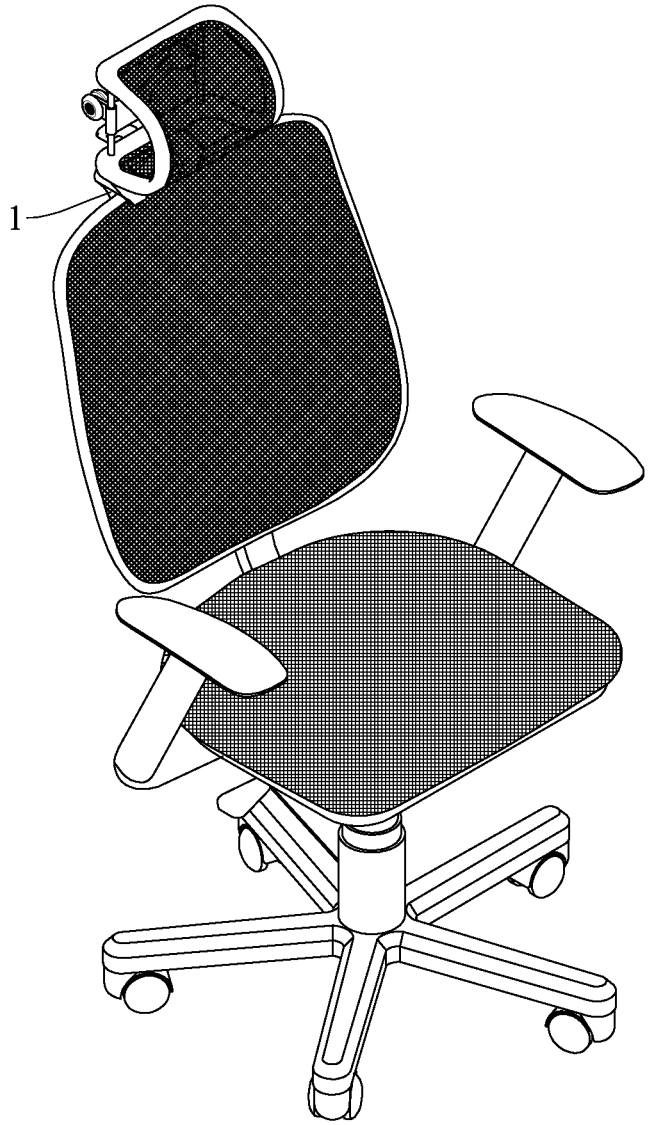
FIG. 5 is a perspective view of the assembled headrest and chair of FIG. 3.

Referring to FIGS. 1 to 12, a reclining headrest 10 for a chair (e.g., office swivel chair) 9 of the invention is shown. The chair 9 comprises a central leg 91, a seat 92 horizontally rotatably mounted on top of the leg 91, and a backrest 93 extending upwardly from the rear end of the seat 92. The headrest 10 as the subject of the invention comprises the following components as discussed in detail below.

A clamping member 1 comprises an upper yoke 11 including two opposite, hollow, cylindrical yoke arms 112 and a recess 111 defined therebetween, and a riser 1121 in one yoke arm 112; two intermediate spaced hook members 12 extending forward downward from both sides of the yoke 11; and a lower well 13 including an upper threaded hole 131 (see circle A of FIG. 1).

A Y-shaped support 2 comprises a lower cup-shaped hinge head 21 including a through hole 211, the hinge head 21 being disposed in the recess 111; and two upper fastening portions 22 at two extremities of the support 2 respectively, each fastening portion 22 including a central groove 221 and a threaded hole 222 on an outer surface.

A head frame 3 comprises two rear bars 31 and two joints 32 each frictionally, slidably fastened on the bar 31, each joint 32 including a threaded through hole 321 on a rear portion. In assembly, two threaded pins 7 are each driven through the threaded hole 222 into the threaded through hole 321 to assemble the head frame 3 and the support 2. Two caps 8 each are releasably mounted on a central portion of an outer surface of the fastening portion 22 to cover the threaded pins 7 so that dust may not accumulate in the fastening portions 22. It is noted that the fastening is not completely fixed. To the contrary, the head frame 3 is allowed to frictionally pivot about the support 2. Further, a padding member, a fabric, or the like may be provided on a front surface of the head frame 3 for comfortably supporting the back of the head when an individual sits on the chair 9.

A hooking member 4 comprises two spaced hook elements 41 curved upward forward, and a top threaded hole 42. A threaded pin 7 can be driven through the threaded hole 42 into the threaded hole 131 to fasten the hooking member 4 and the clamping member 1 together. The hook elements 41 may cooperate with the hook members 12 to mount the headrest 10 on an upper portion of the backrest 93.

A first hinge element 5 is disposed in one yoke arm 112 and comprises an extending lever 51, a central through hole 52, and a cavity 53 complimentary to the riser 1121. A second hinge element (e.g., bearing) 6 is moveably disposed in both the other yoke arm 112 and the through hole 211 of the hinge head 21 and comprises a central through hole 61. A bolt 7 may be driven through the central through hole 52, the through hole 211, and the central through hole 61 into a nut to assemble the clamping member 1 and the support 2. Two caps

8 each are releasably mounted on a central portion of an outer surface of the fastening portion 22 to cover the head of the bolt 7 and the nut so that dust may not accumulate in the first hinge element 5 and the second hinge element 6. It is noted that the fastening is not completely fixed. To the contrary, the support 2 is allowed to frictionally pivot about the clamping member 1.

Adjustment operations of the invention are described in detail below.

Figure 6:
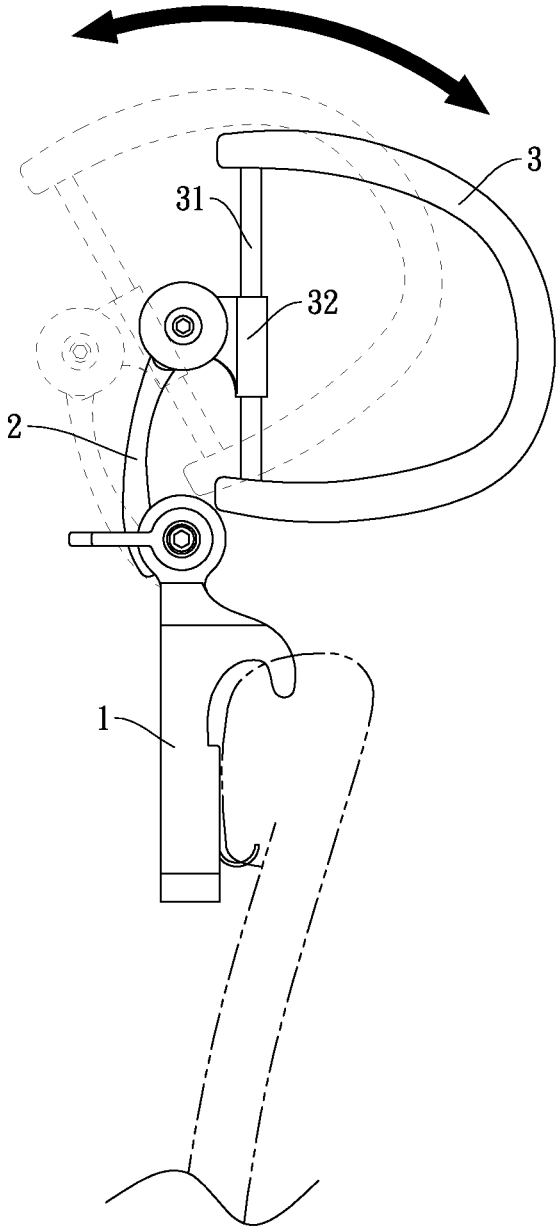
FIG. 6 is a view similar to FIG. 4 showing a tilt angle adjustment operation of the headrest.

As shown in FIG. 6, an individual may pivot the support 2 about the clamping member 1 so as to adjust a tilt angle of the head frame 3. After adjusting the head frame 3 to a desired angle, the individual may counterclockwise turn the lever 51 (see FIG. 9). The second hinge element 6 then co-rotates to push the hinge head 21 toward one yoke arm 21. And in turn, one yoke arm 21 moves until the riser 1121 engages with the cavity 53 (see FIG. 10). The individual may further turn the level 53 to tighten the engagement (i.e., the hinge head 21 being fastened). As a result, the adjusted tilt angle of the support 2 (i.e., the head frame 3) can be maintained.

Figure 7:
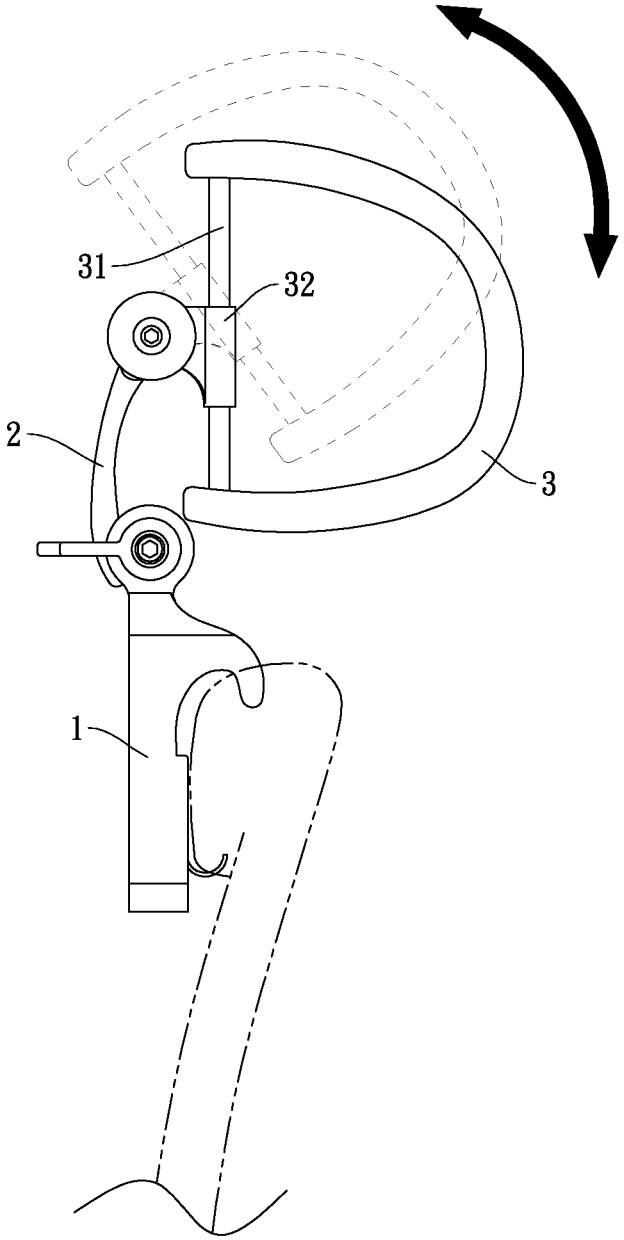
FIG. 7 is a view similar to FIG. 6 showing another tilt angle adjustment operation of the headrest.

As shown in FIG. 7, the individual may hold the head frame 3 to pivot about the support 2 until a desired tilt angle of the head frame 3 is reached. Advantageously, the adjusted tilt angle of the head frame 3 can be maintained due to the frictional fastening of the joints 32 and the fastening portions 22.

Figure 8:
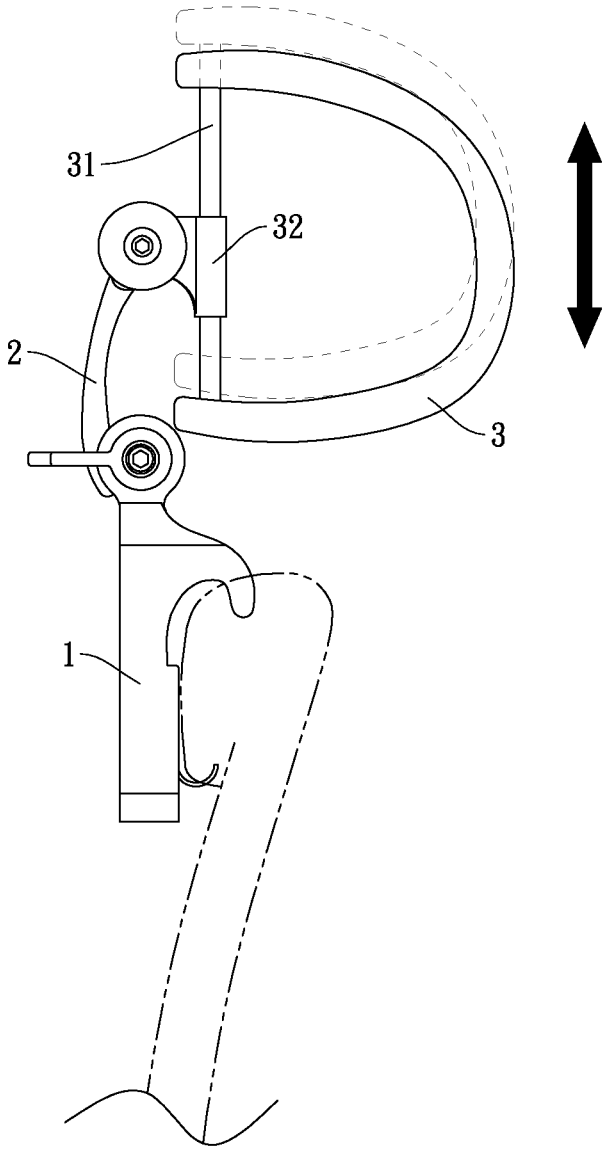
FIG. 8 is a view similar to FIG. 7 showing a height adjustment operation of the headrest.
Figure 9:
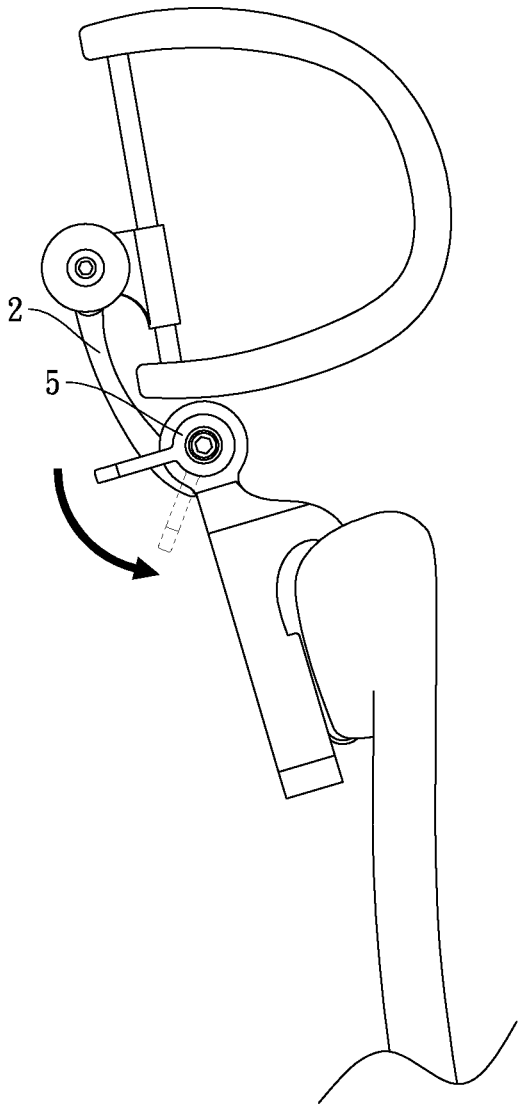
FIG. 9 is a view similar to FIG. 6 showing a counterclockwise rotation of the first hinge element to fasten the tilt angle of the support.
Figure 10:
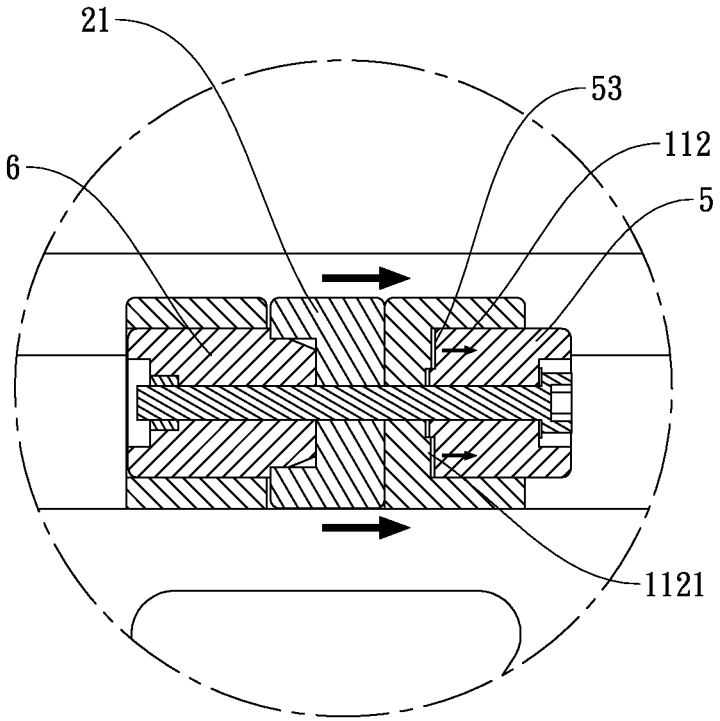
FIG. 10 is a cross-sectional view of the first hinge element, the second hinge element, and adjacent components showing the fastening of FIG. 9.
Figure 11:
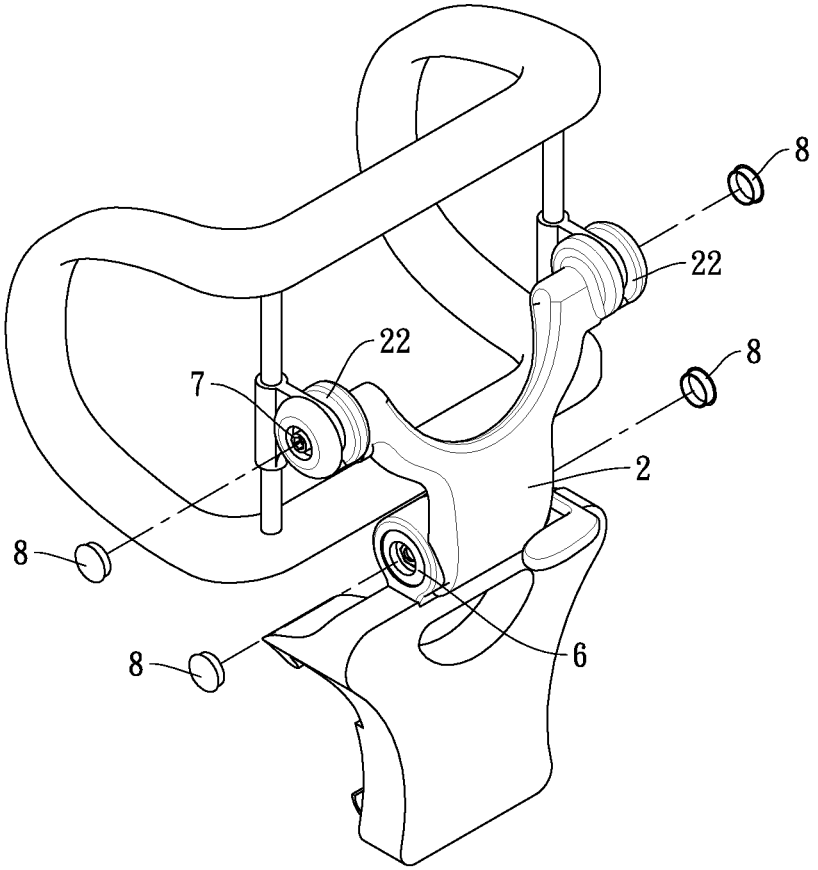
FIG. 11 is an exploded perspective view of the headrest.
Figure 12:
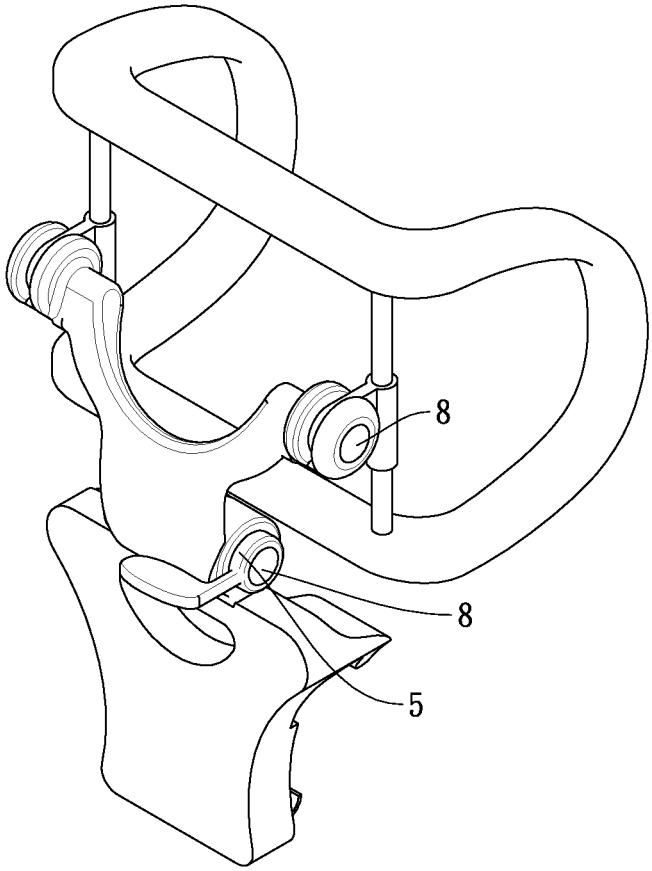
FIG. 12 is a perspective view of the assembled headrest shown in FIG. 11.

As shown in FIG. 8, the individual may hold the support 2 with one hand and hold the head frame 3 with the other hand. Further, the individual may slide the head frame 3 about the joints 32 to lift or lower the head frame 3. This is the height adjustment mechanism of the headrest 10.

While the invention has been described in terms of preferred embodiments, those skilled in the art will recognize that the invention can be practiced with modifications within the spirit and scope of the appended claims.

What is claimed is:

1. A chair comprising:

at least one leg;

a seat rotatably mounted on a top portion of the at least one leg;

a backrest extending upwardly from a rear end of the seat; and a headrest comprising:

a clamping member comprising an upper yoke including two opposite, hollow, cylindrical yoke arms; two intermediate spaced hook members extending forward downward from both sides of the yoke respectively; and a lower well;

a support comprising a cup-shaped hinge head pivotably disposed between the yoke arms; and two opposite fastening portions;

a head frame comprising two rear bars and two joints each frictionally, slidably fastened on one of said two rear bars, each joint being frictionally, pivotably secured to one of said two opposing fastening portions;

a hooking member fastened in the well and comprising two spaced hook elements curved upward forward wherein the hook elements cooperate with the hook members to releasably mount the headrest on an upper portion of the backrest;

a first hinge element pivotably disposed in one yoke arm and comprises a lever; and a second hinge element moveably disposed in the other yoke arm and the hinge head, wherein the lever can be rotated counterclockwise to securely fasten the hinge head.

2. The chair of claim 1, wherein the second hinge element is a bearing.

3. The chair of claim 1, further comprising a riser formed in one yoke arm.

4. The chair of claim 3, wherein the first hinge element further comprises a cavity complimentary to the riser.

* * * * *